US006605910B2

(12) United States Patent
Mullet et al.

(10) Patent No.: US 6,605,910 B2
(45) Date of Patent: Aug. 12, 2003

(54) METHOD AND DEVICE FOR SETTING CUSTOM DOOR TRAVEL LIMITS ON A MOTORIZED GARAGE DOOR OPERATOR

(75) Inventors: Willis J. Mullet, Gulf Breeze, FL (US); David B. Davies, Pace, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 78 days.

(21) Appl. No.: 09/966,886

(22) Filed: Sep. 28, 2001

(65) Prior Publication Data

US 2003/0062865 A1 Apr. 3, 2003

(51) Int. Cl.[7] ..... E05F 15/10

(52) U.S. Cl. ..... 318/264; 318/266; 160/1; 160/188

(58) Field of Search ..... 318/162, 264, 318/265, 266, 286, 466, 467, 468, 469; 388/904; 160/1, 130, 185, 188, 194, 218, 222, 229.1

(56) References Cited

U.S. PATENT DOCUMENTS

| | | | | | |
|---|---|---|---|---|---|
| 4,408,146 | A | * | 10/1983 | Beckerman | 318/264 |
| 4,638,433 | A | | 1/1987 | Schindler | 364/400 |
| 4,706,727 | A | | 11/1987 | Leivenzon et al. | 160/188 |
| 4,831,509 | A | | 5/1989 | Jones et al. | 364/167.01 |
| 5,278,480 | A | | 1/1994 | Murray | 318/626 |
| 5,929,580 | A | * | 7/1999 | Mullet et al. | 318/466 |
| 6,051,947 | A | | 4/2000 | Lhotak et al. | 318/445 |
| 6,078,249 | A | * | 6/2000 | Slavik et al. | 338/180 |
| 6,097,166 | A | | 8/2000 | Fitzgibbon et al. | 318/471 |
| 6,107,765 | A | | 8/2000 | Fitzgibbon et al. | 318/266 |
| 6,118,243 | A | * | 9/2000 | Reed et al. | 318/468 |
| 6,161,438 | A | | 12/2000 | Mullet et al. | 73/774 |
| 6,253,824 | B1 | | 7/2001 | Mullet et al. | 160/188 |
| 6,326,751 | B1 | * | 12/2001 | Mullet et al. | 318/434 |
| 6,414,454 | B1 | * | 7/2002 | Lhotak et al. | 318/266 |

* cited by examiner

*Primary Examiner*—Bentsu Ro
(74) *Attorney, Agent, or Firm*—Renner, Kenner, Greive, Bobak, Taylor & Weber

(57) ABSTRACT

A door operator and related method of setting custom limits on movable barrier travel, includes a motor for moving the movable barrier between two travel limit positions, an operator for controlling operation of the motor, and a disconnect system coupled between the motor and the operator. The disconnect system is switchable between a connected position and a disconnected position, wherein the motor can engage the operator only when the disconnect system is in the connected position. The operator is connected to a potentiometer for ascertaining movable barrier position, regardless of the position of the disconnect system, and provides position information to the operator. A travel limit is set by placing the disconnect system in the disconnected position and manually moving the door to a desired position whereupon the disconnect system is moved to the connected position so that the operator can detect a positional location to be designated as one of the travel limits. An installation switch may be connected to the operator, wherein the operator determines a custom lower limit or a custom upper limit from the desired position as detected by the potentiometer, wherein actuation of the installation switch establishes the custom limit. An up/down switch may also be connected to the operator. Actuation of the up/down switch during setting of the operational profile and after setting of the custom lower limit sets a custom upper limit.

19 Claims, 6 Drawing Sheets

METHOD AND DEVICE FOR SETTING CUSTOM DOOR TRAVEL LIMITS ON A MOTORIZED GARAGE DOOR OPERATOR

TECHNICAL FIELD

Generally, the present invention relates to a garage door operator system for use on a closure member moveable relative to a fixed member. More particularly, the present invention relates to an operator-controlled motor for controlling the operation of a closure member, such as a gate or door, between a closed position and an open position. More specifically, the present invention relates to an operator-controlled motor for a door or gate operator, which allows for simplified custom setting of closure member travel limits

BACKGROUND ART

For convenience purposes, it is well known to provide garage doors which utilize a motor to provide opening and closing movements of the door. Motors may also be coupled with other types of movable barriers such as gates, windows, retractable overhangs and the like. An operator is employed to control the motor and related functions with respect to the door. The operator receives command signals for the purpose of opening and closing the door from a wireless remote, from a wired wall station or other similar device. It is also known to provide safety devices that are connected to the operator for the purpose of detecting an obstruction so that the operator may then take corrective action with the motor to avoid entrapment of the obstruction.

A newer generation of operating systems have been found to provide improved sensitivity to extraneous forces applied to a door during its movement. One such device is disclosed in U.S. Pat. No. 6,161,438, which is assigned to the present assignee of this invention and which is incorporated herein by reference. Briefly, this patent discloses use of a potentiometer coupled to the door for determining a plurality of positional locations between the open and closed positions. A processor contained in the operator correlates the position of the door with an applied force for use in comparison to a predetermined threshold. If, during movement of the door, the applied force is outside the limits of the predetermined threshold, corrective action can be taken. With this increased sensitivity, safety standards allow use of the above operator system without an external safety system on anti-pinch doors.

These motorized garage door operators are known to have force adjustments that can be either mechanically or electronically controlled. This allows the installer, or the consumer, a way of adjusting the force that the operator exerts on the door. The amount of force to move the door will vary with the weight of the door, but can also vary as the environment changes and as the door becomes worn with age. Generally, the information necessary to properly set these limits is contained in the owner's/installation manual. Manual adjustment or selection is provided to allow the user or the installer of the door operator to set position limits which coincide with the fully open and fully closed positions of the door, and to set sensitivity limits which permit sufficient torque to move the door throughout its complete range in both opening and closing direction, but not enough torque to damage the door. A given model of operator may be intended for use on light doors, which might be damaged by too much torque, as well as heavy doors. It is important to match the operator to the door by using the sensitivity setting to achieve proper operation without damage to the door.

The sensitivity setting and the position limits are also used in obstruction detection for stopping the door to prevent damage by or to the obstruction. By using the maximum sensitivity, which is consistent with proper door operation, the damage by or to an obstruction can be minimized. It is a requirement that an obstruction detection feature be utilized during door movement except for the last inch of travel prior to the closed position. Thus the closed position limit is useful in identifying the door position above which obstruction detection is enabled.

U.S. Pat. No. 6,161,438 to Mullet, et al. discloses an internal entrapment system for a door movable by a repeatable force that includes a force-generating device for transferring the door between a first and a second position. A trolley arm connected between the force generating device and the door is continually strained during movement of the door. A sensor mounted on the trolley arm generates a signal representative of the strain applied to the trolley arm. A processor receives the strain signal for comparison to a predetermined threshold, when the strain signal exceeds the predetermined threshold, the processor at least stops the force-generating device. A potentiometer is coupled to the door for determining a plurality of positional locations of the door between the first and the second positions, wherein the processor correlates the position of the door with the strain signal for use in comparison to the predetermined threshold. A power supply provides electrical power to the force generating device, the sensor, the processor, and the potentiometer, and a decoder/amplifier circuit, which also receives electrical power from the power supply and receives the strain signal for conversion into a format acceptable for use by the processor.

U.S. Pat. No. 6,107,765 Fitzgibbon, et al. discloses a movable barrier operator that includes a wall control switch module having a learn switch thereon. The switch module is connectable to a control unit positioned in a head of a garage movable barrier operator. The head unit also contains an electric motor, which is connected to a transmission for opening and closing a movable barrier such as a garage door. The switch module includes a plurality of switches coupled to capacitors which, when closed, have varying charge and discharge times to enable which switch has been closed. The control unit includes an automatic force incrementing system for adjusting the maximal opening and closing force to be placed upon the movable barrier during a learn operation. Likewise, end of travel limits can also be set during a learn operation upon installation of the unit. The movable barrier operator also includes an ambient temperature sensor which is used to derive a motor temperature signal, which motor temperature signal is measured and is used to inhibit motor operation when further motor operation exceeds or is about to exceed set point temperature limits.

U.S. Pat. No. 6,097,166 Fitzgibbon, et al. discloses a movable barrier operator which includes a wall control switch module having a learn switch thereon. The switch module is connectable to a control unit positioned in a head of a garage movable barrier operator. The head unit also contains an electric motor, which is connected to a transmission for opening and closing a movable barrier such as a garage door. The switch module includes a plurality of switches coupled to capacitors which, when closed, have varying charge and discharge times to enable which switch has been closed. The control unit includes an automatic force incrementing system for adjusting the maximal opening and closing force to be placed upon the movable barrier during a learn operation. Likewise, end of travel limits can also be set during a learn operation upon installation of the unit. The movable barrier operator also includes an ambient temperature sensor which is used to derive a motor temperature signal, which motor temperature signal is measured and is used to inhibit motor operation when further motor operation exceeds or is about to exceed set point temperature limits.

U.S. Pat. No. 6,051,947 Lhotak, et al. discloses an operator for opening and closing movable barriers such as garage doors comprising a pass point limit system, which is a component of an operating head. The operator is responsive to remote control from a wall panel or other location remote from the operating head to enable setting and adjustment of door travel limits from a remote location, without requiring installation of limit switches separate from the operating head.

U.S. Pat. No. 5,278,480 Murray discloses a garage door operator that has a microcomputer based control which is programmed to measure door position from fall open position by counting motor revolutions and to determine motor speed and deceleration for each revolution. The program learns the open and closed position limits as well as force sensitivity limits for up and down operation with minimal user input. During normal door operation the closed limit and the sensitivity limits are adaptively adjusted to accommodate changes in conditions. The lowest up and down motor speeds in each operation are stored for comparison with motor speeds in the next like operation for obstruction detection. Motor deceleration is also monitored for obstruction detection. For a more sensitive obstruction detection during closing, the motor speed is mapped for each revolution for the last several inches of closing. The map is stored after each successful closing operation and the corresponding speeds in the next closing are compared point-by point with the mapped speeds to detect slow down due to touching an obstruction U.S. Pat. No. 4,831,509 Jones, et al. discloses a door controller for roller type doors that incorporate a microprocessor control system. The microprocessor measures and stores the door speed over segments of the door travel to generate a door speed travel characteristic. This characteristic enables the door controller to accurately assess obstruction conditions by comparing a real time characteristic with a stored characteristic. The microprocessor also stores electronically the upper and lower limits of door travel. The microprocessor monitors electric motor duty cycle to avoid overheating of the motor and possible burnout while also controlling locking of the drive mechanism when the motor is inoperative. The microprocessor is also used to set the radio control signal code used to activate the door drive mechanism, the setting procedure allows for immediate verification of the set code.

U.S. Pat. No. 4,706,727 to Leivenzon, et al. discloses a door operator for an overhead garage door that has a reversible electric motor and a gear train driving the door. Limit stops are provided, one for the "up" limit and another for the "down" limit. Each of the limit stops is independently zero setable to cut off current to the motor at a pre-selected position.

U.S. Pat. No. 4,638,433 Schindler discloses a microprocessor controlled garage door operator which eliminates lower and upper limit switches on the garage door in that the upper and lower limits are set in a program mode of the microprocessor with up and down control switches by the operator. The settings of the door are stored in the memory of the microprocessor. The microprocessor also sets the force limits by establishing them slightly above the actual force required to move the door up and down and this prevents the forces to be set greater than required which could result in a dangerous condition. An external security switch is also connected to the microprocessor of the garage door operator to allow the door to be opened by those knowing the code. In program mode, the user enters in the 4-digit code and the 4 numbers are stored.

These methods have resolved a number of functional problems but the solutions have created other problems. Resetting the travel limits automatically does not allow for installations where a support beam for the superadjacent floor is located where the door will contact the support beam before the operator has set the upper limit. Custom setting of limits as described in Fitzgibbon, et al allow for a more precise position setting but the installer must hold the learn button—at the operator head—depressed until the door has reached the desired height then release the button to set the new height. Further it is common to not have the capability of setting the down limit. Normally the down limit is set as the door is moved in the closing direction until it reaches the floor and stalls out or the door cycle is started with the door in the closed position, in either case, the door being in contact with the floor sets the down limit. As mentioned before, if there is buckling of the ground during colder months the door may automatically reset for the up-heaved floor and then a gap will appear when the weather is warmer and the floor returns to its original height.

The practice of setting force limits with offsets large enough to anticipate changing conditions results in low sensitivity to the detection of obstructions. It is preferred that such an offset be small to attain high sensitivity. Thus another method of accommodating changes in door opening and closing force is desired. It is thus desirable to automatically change the closed and open limit position to reflect the actual end of door travel, and to accomplish such a change in limit without manually entering the program mode.

DISCLOSURE OF INVENTION

It is thus an object of the present invention to provide a system and method for the setting of custom door travel limits on a motorized door operator. A moveable barrier, which is commonly referred to as a door or gate, is of the type that is moveable into an out-of-proximity position with a fixed surface that is to be sealed relative to the door. The door or gate is coupled to a motorized operator which controls movement of the door or gate.

It is a further object of the present invention, as set forth above, to provide a mechanism such as counter-balance springs coupled to the motor and the operator to assist in moving the barrier in a desired direction. It is yet another object of the present invention, as set forth above, to provide an up/down switch that generates control signals that are received by the operator. The up/down switch may be actuated by a hard-wired control button, a main remote control button, an alpha-numeric keypad, or the like.

It is still another object of the present invention, as set forth above, to provide an operator to utilize a force profile to monitor the operating characteristics of the motor with respect to barrier position during barrier travel. It is still a further object of the present invention, as set forth above, to provide an operator that initiates corrective action whenever the motor applies a force outside the predetermined threshold. It is an additional object of the present invention, as set forth above, to provide an operator which is micro-processor based that contains the necessary memory, hardware, and software for storing a force threshold and software routines for measuring forces for comparison to the force threshold.

It is yet another object of the present invention to provide a potentiometer that detects the position of the movable barrier regardless of whether the motor is coupled to the operator or not. As such, it is the object of the present invention for the operator to detect door position regardless of whether movement is by the motor or manually. Yet another object of the present invention is to provide an installation button for establishing a door profile for opening and closing cycles of the barrier movement. Accordingly, it is another object of the present invention to provide a normal installation cycle when the door is positioned to a fully closed position whereupon actuation of the installation button causes the operator to move the door to a full open position and then stop. The operator then energizes the motor to return the door to a closed position and then this cycle is repeated to verify the operational forces associated with door movement. The foregoing procedure also sets the door limits when the motor stalls out upon reaching the end portion of the track carrying the movable barrier and upon reaching the floor of the opening which is enclosed by the movable barrier.

It is still a further object of the present invention to provide a disconnect system that allows for selective engagement between the operator and the motor. In the normal connected position, the operator is in direct communication with motor and monitors its various functions and provides commands for starting, stopping and reversing the motor as needed. It is another object of the present invention to provide a disconnected position for the disconnect system wherein the motor is disconnected from the operator so that energization of the motor does not result in barrier movement. It is a further object of the present invention to allow for manual movement of the movable barrier in such a manner that the potentiometer continually communicates with the operator to advise of door position. It is still a further object of the present invention for the status of the disconnect system to be detected by the operator.

It is yet another object of the present invention to provide an up/down switch for enabling the operator to control the motor and instruct the motor to proceed upwardly or downwardly as needed. It is another object of the present invention to provide the up/down switch so that it is directly wired to the operator. Alternatively, a remote up/down switch may be used in the normal operation of the movable barrier, wherein the remote operates by either infrared or radio frequency signals. It is another object of the present invention to provide for the setting of custom travel limits to accommodate building obstructions or for any reason deemed necessary by the end user. Therefore, it is an object of the present invention to allow for setting upper and lower limits of door travel, other than the normal stall limits, on a motorized door operator wherein the operator utilizes the potentiometer and the processor for generating and maintaining custom door operational profiles by positioning the door at a desired limit prior to initiating an installation routine. It is another object of the present invention to provide a method of setting the upper limit of door travel, other than the normal stall limit, on a motorized door operator where the operational controls utilize the potentiometer and the processor for generating and maintaining a custom door operational profile by initiating a signal during the first cycle of the installation routine to set the upper limit.

In general, the present invention contemplates a door operator for setting limits on movable barrier travel including a motor for moving the movable barrier between two travel positions, an operator for controlling operation of the motor, and a disconnect system coupled between the motor and the operator, wherein the disconnect system is switchable between a connected position and a disconnected position and wherein the motor can engage the operator only when the disconnect system is in the connected position. A potentiometer is associated with the operator for ascertaining movable barrier position regardless of the position of the disconnect system. The invention further contemplates setting a travel limit by placing the disconnect system in the disconnected position and manually moving the door to a desired position whereupon the disconnect system is moved to the connected position so that the operator can detect a positional location to be designated as one of the travel limits. The operator may also be associated with an installation switch so that the operator can determine either a lower or upper limit from the desired position as detected by the potentiometer, wherein actuation of the installation switch establishes the respective travel limit. The particular travel limit is determined by where the door is manually moved with respect to the overall size of the opening.

The invention also contemplates a door operator which incorporates an up/down switch for enabling the operator to control operation of the motor. The setting of a limit with the up/down switch is implemented by first actuating the installation switch which begins establishment of an operational profile and wherein actuation of the up/down switch during establishment of the operational profile sets a travel limit for the movable barrier as determined by the potentiometer. The invention also contemplates that the lower limit is set by using the aforementioned disconnect system, and then the upper limit is set by using the up/down switch.

The invention further contemplates a method for setting travel limits for a motorized movable barrier for an opening controlled by an operator, wherein the position of the movable barrier is monitored by a potentiometer and wherein a disconnect system is interposed between the operator and the motor. The method employs the steps of disconnecting the movable barrier from the operator by disengaging the disconnect system and manually positioning the movable barrier to a desired travel limit which is observed by the potentiometer and communicated to the operator. The method is completed by re-connecting the movable barrier to the operator and re-engaging the disconnect system whereupon the operator stores the desired travel limit. Upon completion of the aforementioned steps an installation switch may be connected to the operator where actuation of the installation switch after the reconnecting step initiates generation of the operational profile from the desired travel limit. Depending upon where the movable barrier is manually positioned determines whether an upper or lower limit is being set. Another method contemplated by the present invention utilizes actuation of an up/down switch after actuation of the installation switch that is establishing an operational profile to determine a travel limit. The travel limit is detected by the potentiometer and stored in a processor carried by the operator whereupon the installation routine continues for establishment of the operational profile. The foregoing methodologies may also be used to first set the lower limit by disconnecting the disconnect system, manually moving the door to a lower limit, reconnecting the disconnect system, and then actuating the installation button. The method then continues by setting an upper limit by actuation of the up/down button in the manner described above.

These and other objects of the present invention, as well as the advantages thereof over existing prior art forms which will became apparent from the description to follow, are accomplished by the improvements hereinafter described and claimed.

BRIEF DESCRIPTION OF THE DRAWINGS

For a complete understanding of the objects, techniques and structure of the invention, reference should be made to the following detailed description and accompanying drawings, wherein.

BEST MODE FOR CARRYING OUT THE INVENTION

Figure 1:
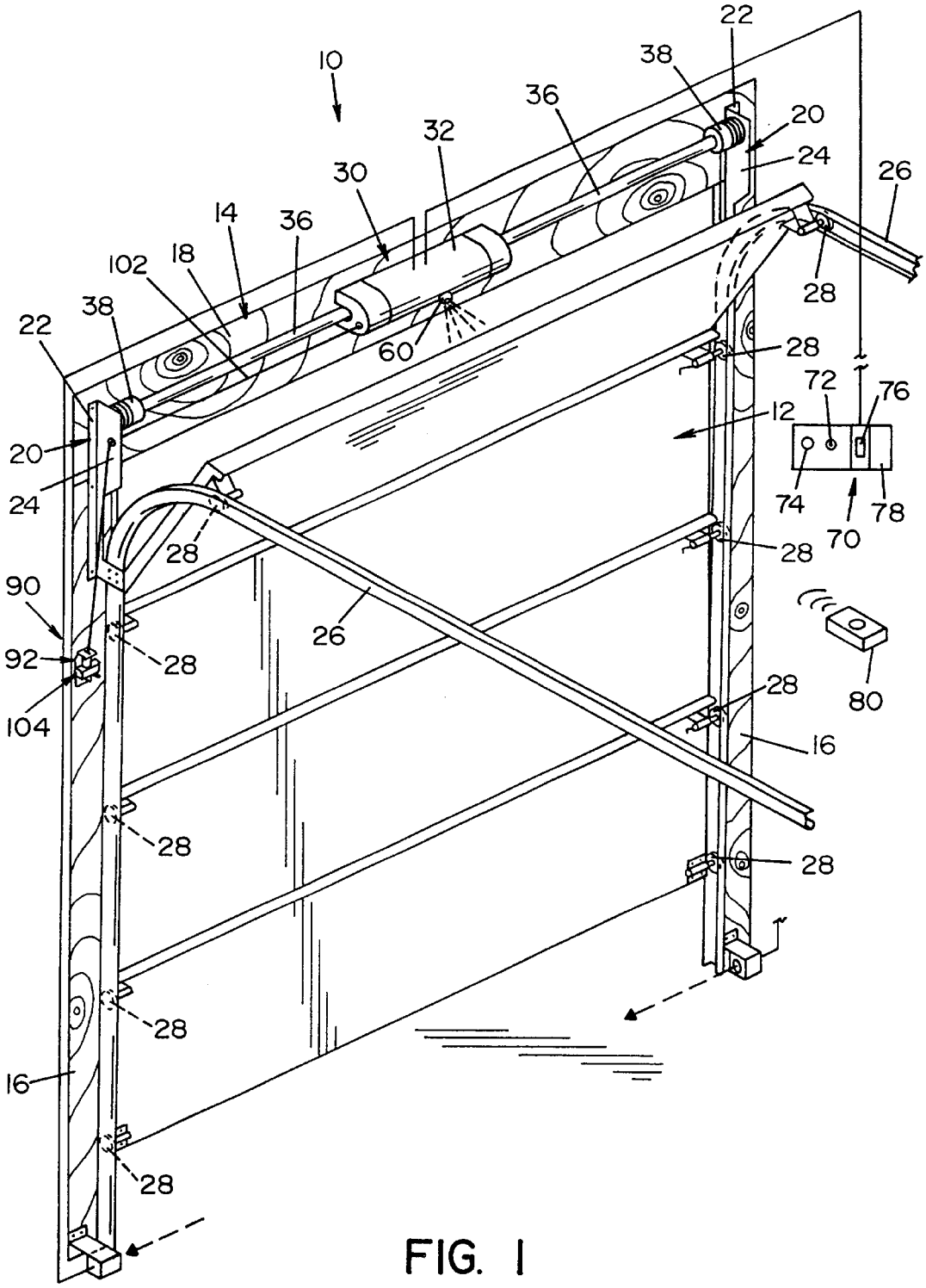
FIG. 1 is a perspective view depicting a sectional garage door and showing an operating mechanism embodying the concepts of the present invention.

A system and related methods for setting custom door travel limits on a motorized garage door operator is generally indicated by the numeral 10 in FIG. 1 of the drawings. The system 10 is employed in conjunction with a conventional sectional garage door generally indicated by the numeral 12. The door 12 may be an anti-pinch or pinch type door. The opening in which the door is positioned for opening and closing movements relative thereto is surrounded by a frame, generally indicated by the numeral 14, which consists of a pair of a vertically spaced jamb members 16 that, as seen in FIG. 1, are generally parallel and extend vertically upwardly from the ground (not shown). The jambs 16 are spaced and joined at their vertically upper extremity by a header 18 to thereby form a generally u-shaped frame 14 around the opening for the door 12. The frame 14 is normally constructed of lumber or other structural building materials for the purpose of reinforcement and to facilitate the attachment of elements supporting and controlling the door 12.

Secured to the jambs 16 are L-shaped vertical members 20 which have a leg 22 attached to the jambs 16 and a projecting leg 24 which perpendicularly extends from respective legs 22. The L-shaped vertical members 20 may also be provided in other shapes depending upon the particular frame and garage door with which it is associated. Secured to each projecting leg 24 is a track 26 which extends perpendicularly from each projecting leg 24. Each track 26 receives a roller 28 which extends from the top edge of the garage door 12. Additional rollers 28 may also be provided on each top vertical edge of each section of the garage door to facilitate transfer between opening and closing positions.

Figure 2:
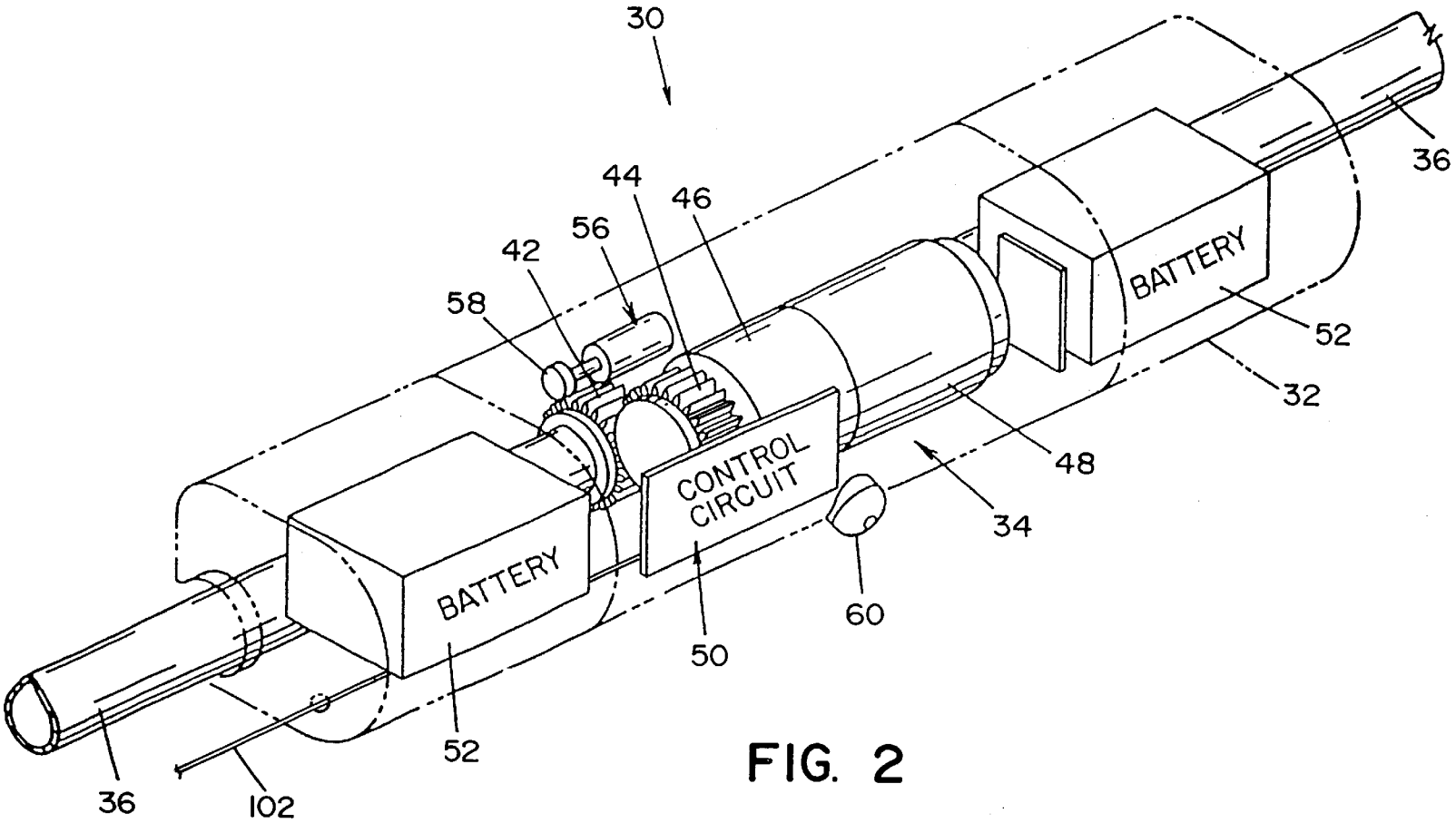
FIG. 2 is an enlarged fragmentary schematic view of the operator mechanism of FIG. 1 as viewed from the inside of the sectional garage door.

A counterbalancing system generally indicated by the numeral 30 may be employed to move the garage door 12 back and forth between opening and closing positions. One example of a counterbalancing system is disclosed in U.S. Pat. No. 5,419,010, which is incorporated herein by reference. Generally, the counter-balancing system 30 includes a housing 32, which is affixed to the header 18 which contains an operator mechanism generally indicated by the numeral 34 as seen in FIG. 2. Extending from each end of the operator mechanism 34 is a drive shaft 36, the opposite ends of which are received by tensioning assemblies 38 that are affixed to respective projecting legs 24. Carried within the drive shaft 36 are counterbalance springs as described in the '010 patent. Although a header-mounted operator is specifically discussed herein, the control features to be discussed later are equally applicable to other types of operators used with movable barriers. For example, the control routines can be easily incorporated into trolley type operators used to move garage doors.

The drive shaft 36 transmits the necessary mechanical power to transfer the garage door 12 between closing and opening positions. The drive shaft 36 provides a drive gear 42 at about a midpoint thereof wherein the drive gear 42 is coupled to a motor gear 44. Driving motion of the motor gear 44 is controlled through a gear box 46 by a motor 48 in a manner well known in the art.

A control circuit 50, which is contained within the housing 32, monitors operation of the motor 48 and various other elements contained within the operator mechanism 34 as will be described hereinbelow. Batteries 52 may be connected to the drive motor 48 for the purpose of energizing the motor 48 and the control circuit 50 to provide any power required for the operation thereof. An external power source may also be used to energize the motor.

A potentiometer generally indicated by the numeral 56 is connected to the drive gear 42 for the purpose of determining positional location of the door 12. The potentiometer 56 may also be employed to provide a speed value for the garage door as it travels between opening and closing positions. To this end, a slider 58 extends from the potentiometer 56 and is coupled to the drive gear 42 to monitor the positional rotation of the drive gear. A sensor 60, which may either be ultrasonic or infrared, is employed to monitor travel of the garage door 12. The sensor 60 is also connected to the control circuit 50 for communication therewith and to stop operation of the counterbalancing system 30 when deemed appropriate.

A pulse counter (not shown) is employed to monitor rotation and speed of the motor 48 in a manner well known in the art. The pulse counter is connected to the control circuit 50 for the purpose of supplying input thereto and allowing the control circuit 50 to take corrective action when required.

It will be appreciated that the control circuit 50 employs a processor which receives power from the batteries 52 or from some other appropriate power supply. The processor includes the necessary hardware, software, and memory to implement operation of the control circuit 50. The potentiometer is also connected to the processor where it can be seen that the potentiometer includes different points with the slider 58 disposed therebetween. In essence, the potentiometer 56 is a variable resistor, wherein the end points have an electrical potential slider across them. If the slider is moved toward the end point with the positive potential, then the slider voltage becomes more positive. If the slider is moved towards the other end point with the negative potential, then the slider voltage becomes more negative. By connecting the slider to the door 12 through the drive gear 42, the potentiometer 56 always outputs a voltage relative to the position of the door 12. If the power supply, for whatever reason, is removed from the control circuit, the slider still points to a position relative to the door. If a user moves the door while the operator mechanism 34 is off, the slider maintains a relative position with respect to the door and is reacquired once power is returned to the operator mechanism 34. In this manner, the processor contained within the operator can determine a force setting for each positional location of the door as it travels through its movement. From this, a force threshold envelope can be developed which accounts for parasitic drag, changes in temperatures which may possibly require a much higher (or much lower) power requirement, either of which can cause a phantom entrapment detection. Accordingly, the force threshold envelope encompasses this range of values.

Operation of the door is initiated by actuation of a control device. As seen in FIG. 1, the control device may either be a wall station 70 or a remote control switch 80. It will be appreciated that the control devices may include other functions for programming the operator, controlling lights associated with the operator and other operator-related functions.

Once the garage door, motor, and operator are installed in place, the wall station 70 is placed in a convenient location. The set-up mechanic then initiates a set-up procedure to set the upper and lower limits of the door travel and also to set an operational profile. As discussed in U.S. Pat. No. 5,929,580, the operational profile is regularly updated and employed as a safety feature to stop travel of the door in the event of an obstruction. Briefly setting of the operational profile and the door travel limits is accomplished by first placing the door in the fully closed position and then inserting a tool (not shown) into the access hole. This actuates a hidden door installation button 72 that starts the door travel in the up direction. Once an upper limit is set—when the motor stalls out due to the door hitting the end of the track—the motor and door reverse direction to determine where the lower limit is located. The door then repeats the open/close cycle to set the operational profile and, upon completion of the procedure, the profile is set. Briefly, the operational profile is sequence of force measurements for incremental door positions in either direction of door travel. During regular operation, if a force measurement at a particular door position is outside of an acceptable force measurement range, the door is at least stopped and, if desired, reversed. Upon completion of each successful door travel cycle, the operational profile is updated. This allows for any minimal changes in force, such as motor wear, to be accounted for in the profile. In any event, completion of the installation procedure may be indicated by flashing of an LED 74. Upon completion of the setup procedure, the door and operator are ready for use. It will be appreciated that use of the foregoing set-up procedure eliminates the need for the mechanic to access programming features that were previously only accessible at the operator. Moreover, the mechanic can now be in a safer location, away from the operator and motor, during set-up.

Figure 3B:
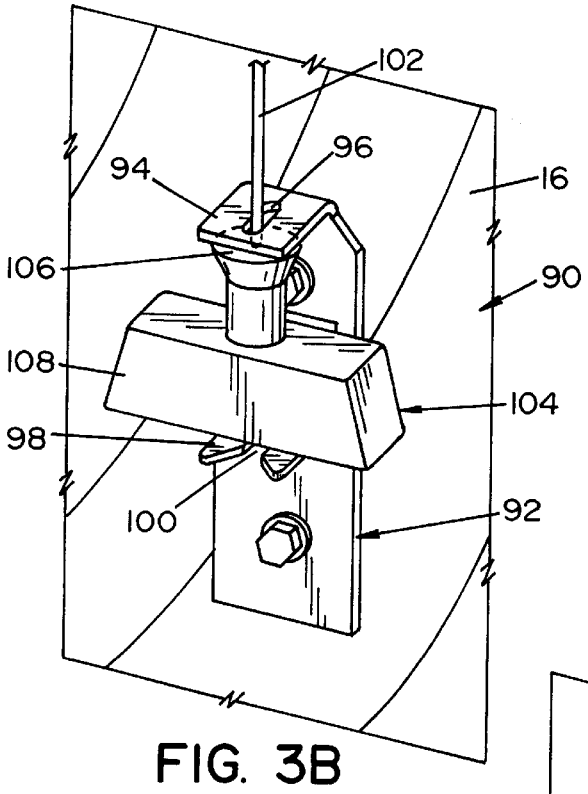
FIGS. 3A and 3B are perspective drawings showing a disconnect system in a disconnected state and connected state.
Figure 3A:
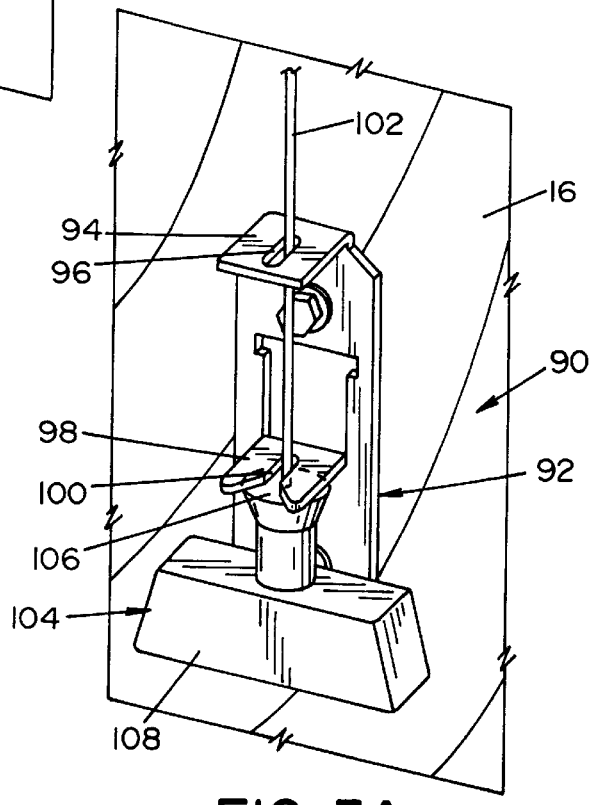

Referring now to FIGS. 3A and 3B, a disconnect system, generally indicated by the numeral 90, is shown. The disconnect system 90 functions to disengage the motor from the operator primarily for safety reasons. In the event the motor wears out or is otherwise rendered inoperable, disengagement of the operator from the motor allows the user to manually open and close the door as needed. The disconnect system 90 includes a bracket 92 that is secured to the jamb member 16, preferably in a position high enough so that it cannot be reached by children. The bracket 92 is secured to the jamb member 16 by conventional means such as threaded fasteners or nails. The bracket 92 has a perpendicularly extending flange 94 which has a hole 96 extending therethrough. The bracket 92 also has a perpendicularly extending arm 98 which is essentially parallel and below the flange 94. The arm 98 provides a slot 100 which may have a tapered entry as shown. A disconnect cable 102 is connected at one end with linkage that connects and disconnects the operator from the motor as disclosed in U.S. Pat. No. 6,253,824, which is incorporated herein by reference. The other end of the cable 102 is connected to a handle 104. The disconnect handle has a collar 106 from which extends a T-section 108. Two different positions are provided by the disconnect system 90. As shown in FIG. 3B, the system is in a connected position wherein the collar 106 is positioned adjacent the flange 94. The handle 104 and cable 102 are assembled such that the cable is captured within the hole 96 so that it cannot travel any further than as show. When it is desired to disconnect the operator from the motor, the user pulls on the T-section 108 and moves the cable in such a fashion that the collar 106 bears against the bottom surface of the arm 98. The cable fits in the slot 100 and is retained therein. When it is desired to re-engage the operator with the motor, the user pulls on the handle slightly and repositions the handle so that the collar 106 bears against the flange 94.

Referring back to FIG. 1 it can be seen that included with the wall station 70 is an up/down button 76. The wall station may also be provided with a light actuation button 78 for turning on an overhead light if desired. Remote control 80 may also be provided to actuate the operator with either an infrared or radio frequency signal. The remote 80 essentially functions in the same manner as the up/down button 76, it may or may not be used in setting of the travel limits.

Figure 4:
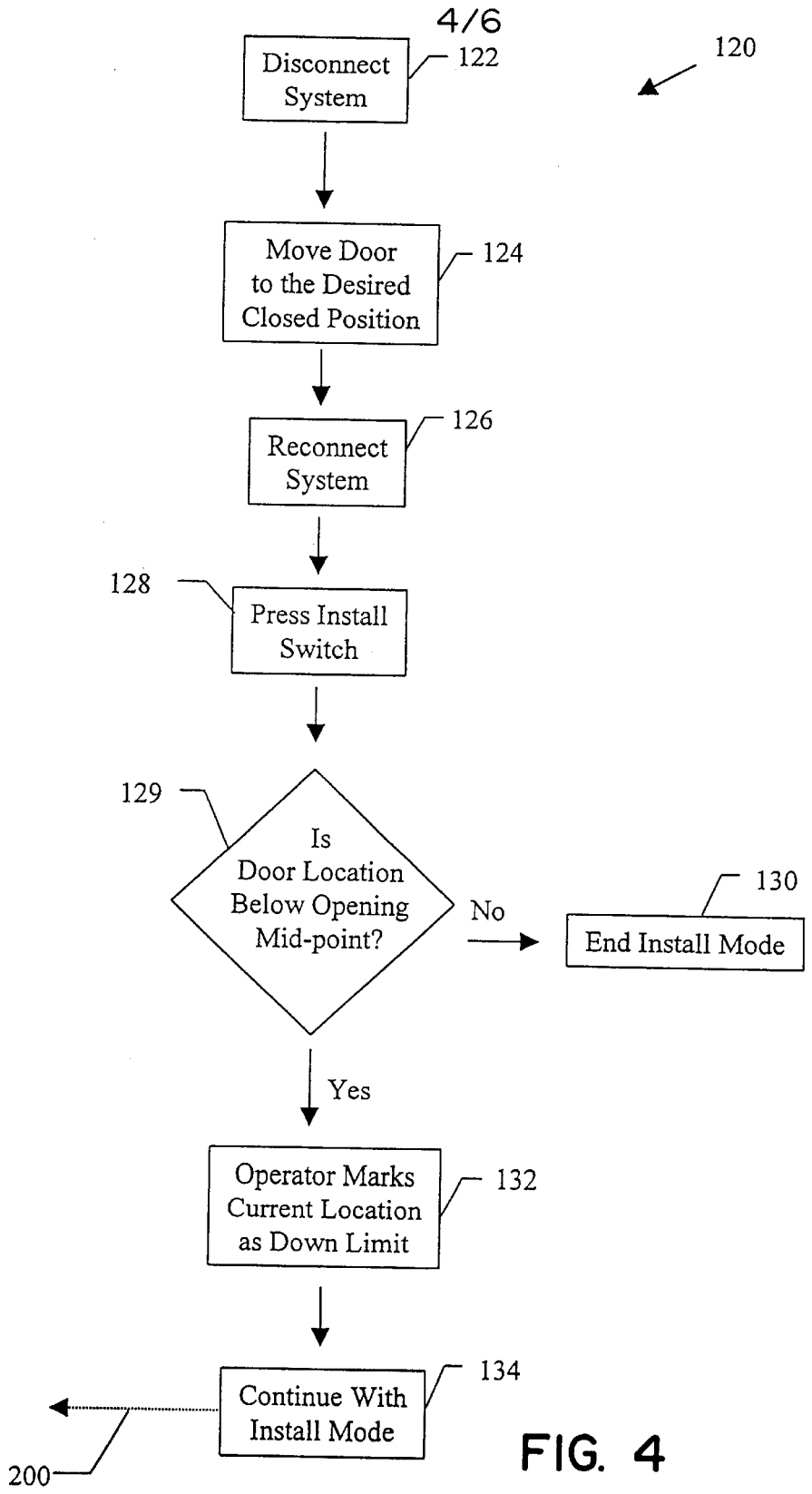
FIG. 4 is an operational flow chart employed by the operator of the present invention for setting a new lower limit.

Referring now to FIG. 4, an operational flow for setting a custom lower limit is designated generally by the numeral 120. As a first step in setting a new lower limit of door travel, for example, to provide ventilation and or to overcome any permanent obstructions positioned at the floor of the opening, at step 122, the disconnect system 90 is accessed so as to move the handle 104 into a disconnected position as shown in FIG. 3A. At step 124, the barrier is manually moved to a desired custom closing position wherein this position is typically less than the midpoint of the entire opening. In standard garage doors it is believed that this position limit will be less than four (4) feet above the floor. While the door is manually moved, the potentiometer 56 keeps track of the door position by virtue of its engagement with the drive shaft 36. In any event, once the desired door position is obtained, the handle 104 is repositioned at step 126 to a connected position as shown in FIG. 3B.

At this time, the set-up mechanic or user actuates the installation button 72 at step 128. At step 129 the operator determines whether the bottom edge of the door is below the enclosure's mid-point height. If it is determined that the door is above the mid-point, then the operator, at step 130, ends the installation mode. This is done to prevent the setting of a lower limit that would allow more than half of the garage door opening to be accessible and also to prevent confusion with the upper travel limits. If, at step 129, it is determined that the door is below the enclosure's mid-point height, then, at step 132, the operator marks that location, as determined by the potentiometer, as the new custom lower limit. At step 134, the operator continues with the install routine to set the other limit and the rest of the operational profile.

Figure 5:
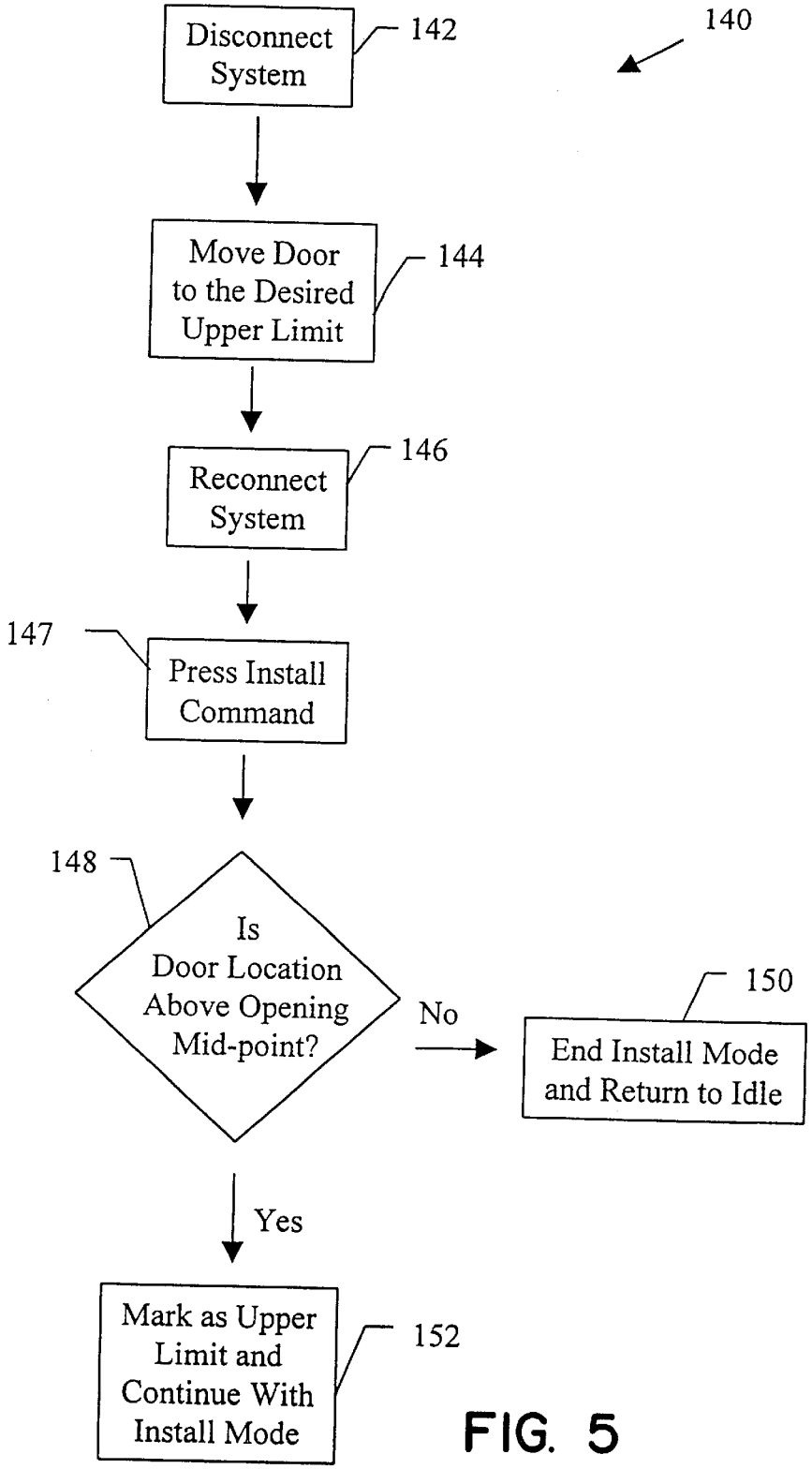
FIG. 5 is an operational flow chart employed by the operator of the present invention for setting a new upper limit with an existing limit already in memory.

When it is desired to set a new upper limit when there is an upper limit already provided in the operator memory, the operator executes the procedural steps shown in FIG. 5 and which is designated generally by the numeral 140. First, the user disconnects the motor from the operator by positioning the handle 104 to the disconnected position as shown FIG. 3A. At step 144 the door is manually moved to a desired upper limit other than the normal install limit primarily for the purpose of avoiding any obstructions that now extend down from the ceiling or otherwise impede the movement of the door at the end of an opening cycle. In any event, the disconnect system 90 is re-engaged at step 146 such that the handle 104 is placed in the position as shown in FIG. 3B. It is believed that the door will be positioned in the upper half of the opening which is typically more than four (4) feet above the floor. At step 147 the installation button 72 is pressed and the operator reengages with the motor. The installation routine is commenced such that the operator accepts the repositioned door as the new upper limit. Accordingly, at step 148 the operator confirms the position of the door and if the door position is not above the enclosures opening, then, midpoint at step 150, the installation mode is ended and the operator is returned to its normal operating mode. However, if at step 148 it is determined that the door is positioned above the enclosures opening midpoint, then at step 152 that position is marked as the upper limit and the operator continues with the installation mode.

Figure 6:
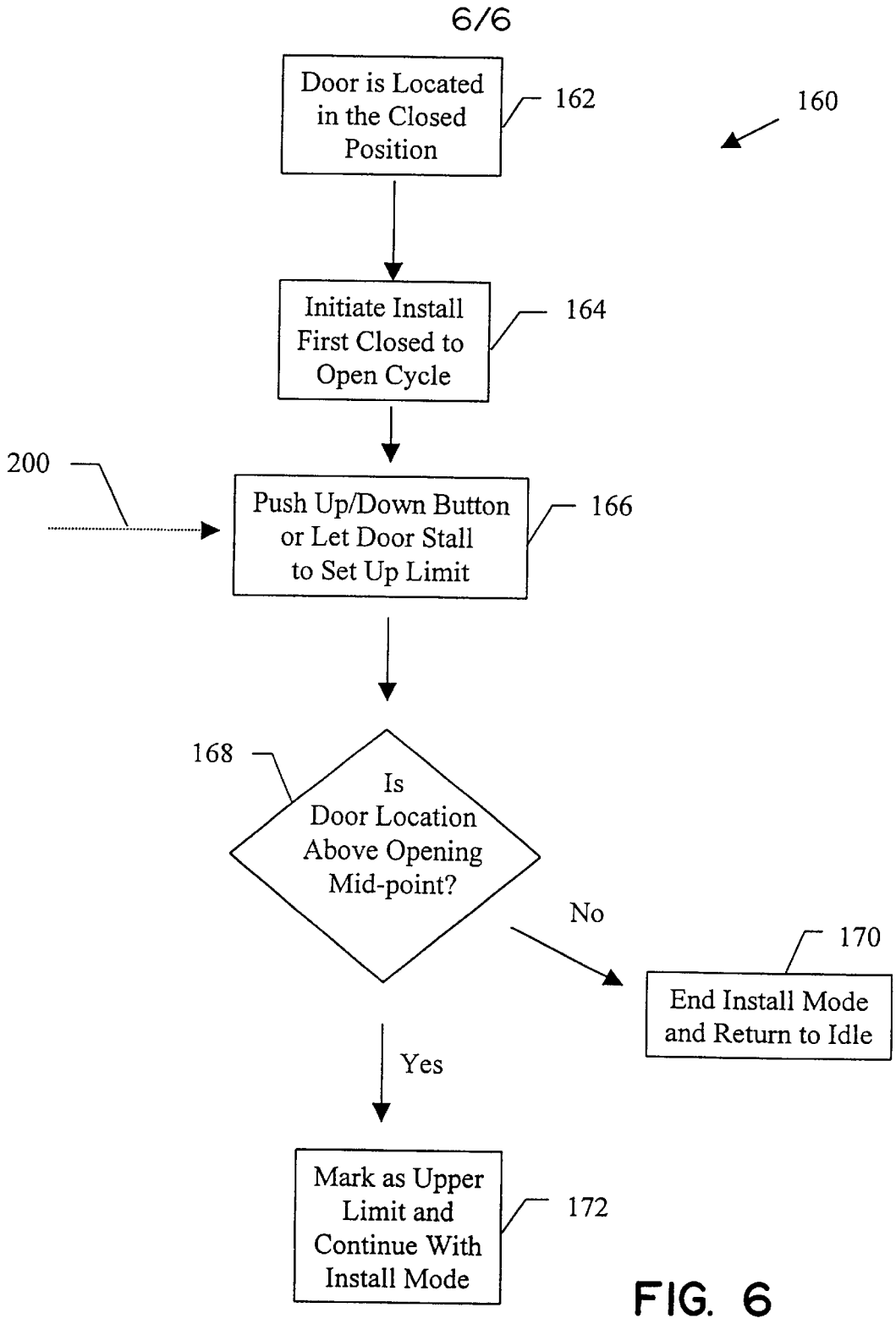
FIG. 6 is an operational flow chart employed by the operator of the present invention for setting a new upper limit with no upper limit in memory.

Referring now to FIG. 6, the procedure for setting a new upper limit where there is no upper limit in memory is generally indicated by the numeral 160. First, the door is located in the closed position adjacent the floor as indicated at step 162. At step 164 the user activates the installation button 72 and the door begins establishing an operational profile. The mechanic or user observes the door travel at this time and at step 166 they push the up/down button 76 to set the upper limit. If no special upper limit is required then the door will be allowed to stall as noted in the prior art. Once the door stops, the operator, at step 168, determines whether the door is located above the enclosure's mid-point which is typically four feet. If the door is not above the enclosure's mid-point, then the installation procedure is ended at step 170. If the door is above the enclosure's mid-point, then at step 172, that position is designated as the operator's upper limit by the operator which then continues with the installation routine to set the other limit and the rest of the operational profile.

If desired, both a custom lower limit and a custom upper limit can be set during a single installation procedure. The procedure for doing so is set forth in FIGS. 4 and 6. Setting of the custom lower limit proceeds as shown in the operational flow 120. At step 134, the set-up procedure may continue as indicated by a transfer step 200 which continues on at step 166 for the purpose of setting the custom upper limit.

From the foregoing methods and the operator's interaction with the other components, it will be appreciated that this invention has several advantages. The aforementioned system allows for the setting of both the upper and lower limits with the capability of manually resetting both the upper and lower limit for custom setting when special needs arise that interfere with the travel of the door but would otherwise not hinder use of the door. These procedures allow for custom setting of the upper and lower limits without stalling out the positioning of the door which upon inducing stress on the motor and the door panels. The potentiometer allows for the permanent setting of the custom limits and these settings remain even if there is a loss of power to the operator. Accordingly, the lower limit may be positioned at any point between the floor and a midpoint and an upper limit can be set anywhere from the midpoint and above.

Thus, it should be evident that the method and device for setting custom door limits for a motorized garage door operator disclosed herein carries out the various objects of the present invention set forth above and otherwise constitutes an advantageous contribution to the art. As will be apparent to those persons skilled in the art, modifications can be made to the preferred embodiments disclosed herein without the parting of the spirit of the invention. Therefore, the scope of the invention herein described shall be limited solely by the scope of the attached claims.

What is claimed is:

1. A door operator for setting at least one custom travel limit on movable barrier travel, comprising:

a motor for moving the movable barrier between two travel limit positions;

an operator for controlling operation of said motor;

a disconnect system coupled between said motor and said operator, wherein said disconnect system is switchable between a connected position and a disconnected position, wherein said operator can drive said motor only when said disconnect system is in said connected position; and a potentiometer for ascertaining movable barrier position, regardless of the position of said disconnect system, said potentiometer providing position information to said operator;

wherein a custom travel limit is set by placing said disconnect system in said disconnected position and manually moving the door to a desired position whereupon said disconnect system is moved to said connected position so that said operator can detect a positional location to be designated as said custom travel limit.

2. The operator according to claim 1, further comprising:

an installation switch connected to said operator, wherein said operator determines a custom lower limit from said desired position as detected by said potentiometer, wherein actuation of said installation switch establishes said custom lower limit.

3. The operator according to claim 2, further comprising:

a switch for enabling said operator to control operation of said motor, wherein actuation of said switch moves the door between said custom lower limit and an upper travel limit.

4. The operator according to claim 3, wherein actuation of said switch after setting of said custom lower limit and during an initial cycle sets a custom upper limit as detected by said potentiometer.

5. The operator according to claim 3, wherein said custom lower limit is less than 4 feet above the floor supporting the movable barrier.

6. The operator according to claim 1, further comprising:

an installation switch connected to said operator, wherein said operator determines a custom upper limit from said desired position as detected by said potentiometer, wherein actuation of said installation switch establishes said custom upper limit.

7. The operator according to claim 6, further comprising:

a switch for enabling said operator to control operation of said motor, wherein actuation of said switch moves the door between said custom upper limit and a lower travel limit.

8. The operator according to claim 7, wherein said custom upper limit is more than 4 feet above the floor supporting the movable barrier.

9. A door operator for setting at least one custom limit on movable barrier travel, comprising:

a motor for moving the movable barrier between two travel limit positions;

an operator for controlling operation of said motor;

a potentiometer for ascertaining movable barrier position, said potentiometer providing position information to said operator;

an up/down switch for enabling said operator to control operation of said motor; and;

an installation switch connected to said operator, wherein actuation of said installation switch causes said operator to run said motor and begin establishment of an operational profile, and wherein actuation of said up/down switch during establishment of said operational profile sets a custom travel limit for the movable barrier as determined by said potentiometer.

10. The door operator according to claim 9, wherein actuation of said up/down switch causes said operator to stop said motor, whereupon said operator sets an upper travel limit from a position location provided by said potentiometer, and whereupon said operator continues with establishment of said operational profile.

11. A method for setting at least one travel limit for a motorized movable barrier for an opening controlled by an operator, wherein the position of the movable barrier is monitored by a potentiometer, and wherein a disconnect system is interposed between the operator and the motor, the method comprising:

disconnecting the movable barrier from the operator by disengaging the disconnect system;

manually positioning the movable barrier to a desired travel limit which is observed by the potentiometer and communicated to the operator; and re-connecting the movable barrier to the operator by re-engaging the disconnect system, whereupon the operator stores said desired travel limit.

12. The method according to claim 11, further comprising:

connecting an installation switch to the operator;

actuating said installation switch after said re-connecting step, wherein the operator initiates generation of an operational profile from said desired travel limit.

13. The method according to claim 12, further comprising:

manually positioning the movable barrier to a position lower than a mid-point of the opening to establish a lower travel limit.

14. The method according to claim 13, further comprising:

connecting an up/down switch to said operator to control operation of said motor; and actuating said up/down switch to move the door between said lower travel limit and an upper travel limit.

15. The method according to claim 13, further comprising:

connecting an up/down switch to said operator to control operation of said motor; and actuating said up/down switch after actuating said installation switch and during generation of said operational profile to establish a custom upper travel limit.

16. The method according to claim 12, further comprising:

manually positioning the movable barrier to a position higher than a mid-point of the opening to establish an upper travel limit.

17. The method according to claim 16, further comprising:

connecting an up/down switch to said operator to control operation of said motor;

actuating said up/down switch to move the door between said upper travel limit and a lower travel limit.

18. A method for setting at least one custom travel limit for a motorized movable barrier, which encloses an opening, controlled by an operator, wherein the position of the movable barrier is monitored by a potentiometer, wherein an up/down switch is connected to the operator to control operation of the motor, and wherein an installation switch is connected to the operator, the method comprising:

actuating the installation switch to initiate operation of said motor and begin establishment of an operational profile;

actuating the up/down switch during establishment of the operational profile to set the at least one travel limit as determined by the potentiometer; and storing said travel limit in a processor carried by said operator.

19. The method according to claim 18, further comprising:

stopping said motor temporarily upon actuation of said up/down switch;

setting an upper travel limit from a position location provided by the potentiometer;

re-starting said motor to complete establishment of the operational profile.

* * * * *